US008419514B2

(12) United States Patent
McKeown

(10) Patent No.: US 8,419,514 B2
(45) Date of Patent: Apr. 16, 2013

(54) APPARATUS FOR CIRCULATING AIR

(76) Inventor: James McKeown, Garland, TX (US)

( * ) Notice: Subject to any disclaimer, the term of this patent is extended or adjusted under 35 U.S.C. 154(b) by 1450 days.

(21) Appl. No.: 12/038,245

(22) Filed: Feb. 27, 2008

(65) Prior Publication Data

US 2009/0215383 A1 Aug. 27, 2009

(51) Int. Cl.
*F24F 7/06* (2006.01)

(52) U.S. Cl.
USPC ..... 454/249; 454/236; 439/165; 439/662

(58) Field of Classification Search ..... 454/233, 454/236, 249; 439/162, 165, 641, 657, 661, 439/662, 663, 664; 165/122, 123, 124, 125; 219/201, 209, 240, 241, 242
See application file for complete search history.

(56) References Cited

U.S. PATENT DOCUMENTS 4,522,255 A * 6/1985 Baker ..... 165/48.1
5,421,701 A * 6/1995 Funston ..... 416/5
6,325,654 B1 * 12/2001 Kerr et al. ..... 439/313
7,381,129 B2 * 6/2008 Avedon ..... 454/230
2007/0045262 A1 * 3/2007 Schehr ..... 219/202
2008/0251508 A1 * 10/2008 Chan ..... 219/209
2011/0021081 A1 * 1/2011 Lin ..... 439/641

* cited by examiner

*Primary Examiner* — John K Fristoe, Jr.
*Assistant Examiner* — Reinaldo Sanchez-Medina
(74) *Attorney, Agent, or Firm* — Michael Ries

(57) ABSTRACT

Disclosed is an apparatus for circulating air. The apparatus comprises a hollow handle assembly having a proximal end and a distal end. The apparatus further includes an air circulation assembly pivotally secured to the proximal end of the hollow handle assembly. The air circulation assembly is capable of generating an air-flow. Moreover, the apparatus includes a connecting fixture coupled to the distal end of the hollow handle assembly. The connecting fixture is capable of being received in a receptacle for a lighting appliance and for providing an electrical connection to the apparatus for circulating the air. The air circulation assembly is adapted to have an angular motion in all directions about the hollow handle assembly.

6 Claims, 4 Drawing Sheets

APPARATUS FOR CIRCULATING AIR

FIELD OF THE INVENTION

The present invention generally relates to an apparatus for circulating air, and more specifically, to the apparatus capable of circulating air evenly in a work area.

BACKGROUND OF THE INVENTION

The use of a heating lamp for heating a work area, for example, a room is conventionally known. For example, the heating lamp may be utilized for the purpose of generating heat for use in showers and bathrooms to warm bathers, and in restaurants to keep food warm before serving. However, conventional heating lamps produce a localized heat, such that the heat emanating therefrom is concentrated in a particular direction only.

To overcome drawbacks of the conventional heating lamps, various types of air blowers are known to be utilized. The air blowers may be mounted on a wall of a room for distributing hot air or the heat over a larger area of the room as compared to the conventional heating lamps. However, such air blowers are adapted to adjust a flow of the hot air in a predetermined direction only. More specifically, the hot air from the air blowers may restrict effective heating area to a region in the vicinity of the air blower. Moreover, the air blowers may be installed only with the help of a professional electrician and may require extensive ductwork for configuring an electrical connection thereof.

Accordingly, there exists a need for an apparatus for circulating air, which evenly circulates the air around a room. Furthermore, there exists a need for an apparatus for circulating air, which is easy to install without requiring any ductwork for installation.

SUMMARY OF THE INVENTION

In view of the foregoing disadvantages inherent in the prior art, the general purpose of the present invention is to provide an apparatus for circulating air and configured to include all the advantages of the prior art, and to overcome the drawbacks inherent therein.

Therefore, an object of the present invention is to provide an apparatus for circulating air evenly around a room.

Another object of the present invention is to provide an apparatus for circulating air, which is adapted to adjust a direction of air-flow generated by the apparatus.

Yet another object of the present invention is to provide an apparatus for circulating air that can be easily installed in a work area without requiring any ductwork therefor.

In light of the above objects, in one aspect, the present invention provides an apparatus for circulating air evenly in all directions in a work area, for example, a room. The apparatus comprises a hollow handle assembly having a proximal end and a distal end. The apparatus further comprises an air circulation assembly pivotally secured to the proximal end of the hollow handle assembly, and a connecting fixture coupled to the distal end of the hollow handle assembly. The air circulation assembly is capable of generating an air-flow. Moreover, the connecting fixture is capable of being received in a receptacle for receiving a lighting appliance, such as a receptacle for a bulb, a lamp and the like. The air circulation assembly further comprises an attachment means adapted to secure the air circulation assembly to the hollow handle assembly.

In another aspect of the present invention, the apparatus for circulating air disclosed herein is capable of adjusting a direction of the air-flow generated by the air circulation assembly.

These together with other aspects of the present invention, along with the various features of novelty that characterize the invention, are pointed out with particularity in the claims annexed hereto and form a part of the present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes and are subject to many variations in structure and design. It should be emphasized, however, that the present invention is not limited to an apparatus for circulating air, as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The terms "a" and "an" herein do not denote a limitation of quantity, but rather denote the presence of at least one of the referenced item.

The present invention discloses an apparatus for circulating air. The apparatus includes a hollow handle assembly having a proximal end and a distal end, an air circulation assembly pivotally secured to the proximal end of the hollow handle assembly, and a connecting fixture coupled to the distal end of the hollow handle assembly. The air circulation assembly is capable of generating an air-flow and is pivotally secured to the proximal end of the hollow handle assembly for enabling an adjustment of the air-flow in a desired direction. More specifically, the apparatus is capable of producing an angular motion of the air circulation assembly in all directions about the hollow handle assembly. Further, the connecting fixture is capable of being received in a receptacle for lighting appliances and providing an electrical connection to the apparatus for circulating the air.

Figure 1:
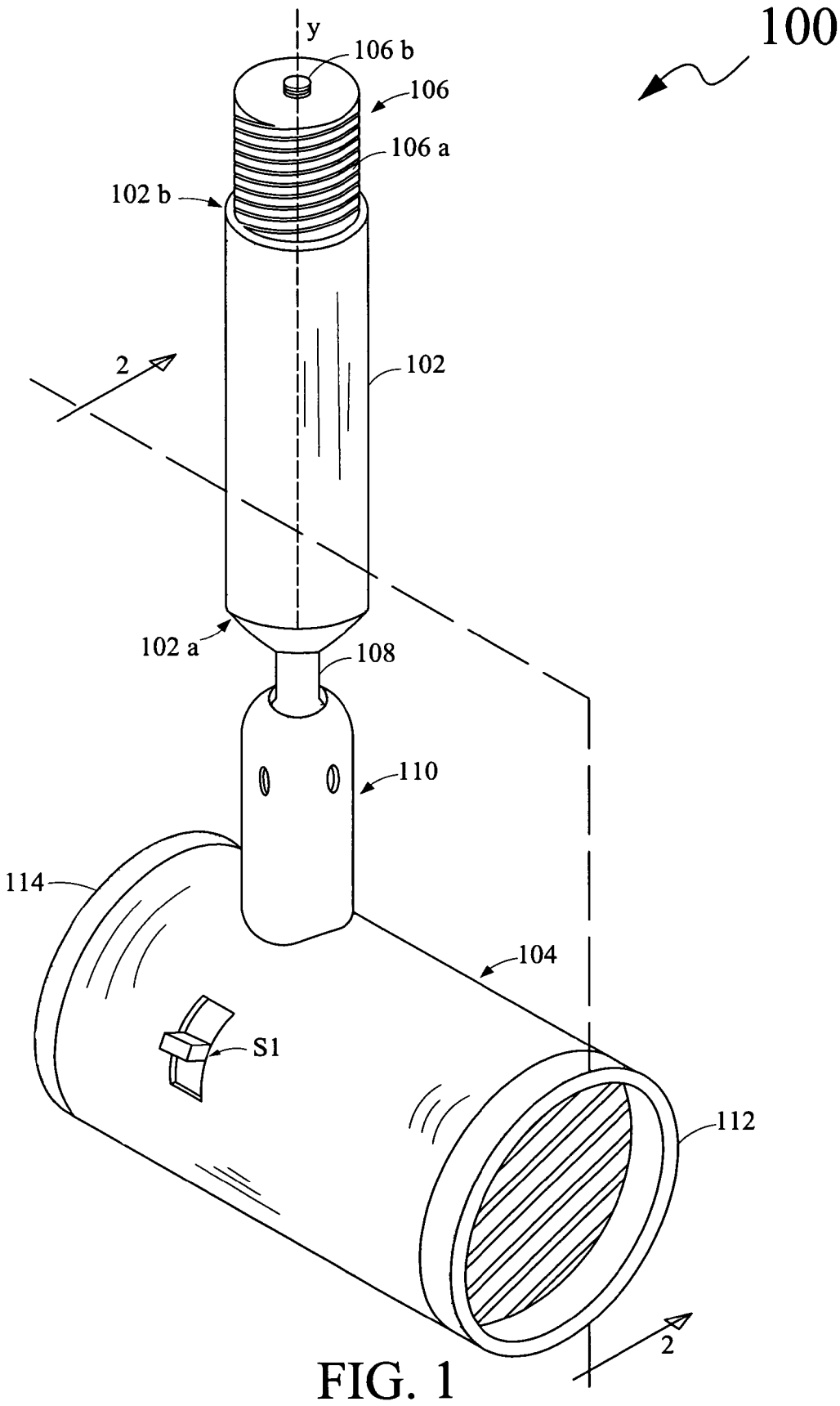
FIG. 1 illustrates a perspective view of an apparatus for circulating air, in accordance with an exemplary embodiment of the present invention.

FIG. 1 depicts a perspective view of an apparatus 100 for circulating air, in accordance with an exemplary embodiment of the present invention. The apparatus 100 includes a hollow handle assembly 102, herein after referred to as the handle assembly, having a proximal end 102*a* and a distal end 102*b*, an air circulation assembly 104 pivotally secured to the proximal end 102*a* of the handle assembly 102, and a connecting fixture 106 coupled to the distal end 102*b* of the handle assembly 102. The handle assembly 102 and the air circulation assembly 104 may be made of material capable of providing sufficient structural integrity to the apparatus 100. For example, the handle assembly 102 and the air circulation assembly 104 may be made of a hard plastic material or a metallic material.

As used herein, the handle assembly 102 is a tubular structure having a longitudinal axis 'y'. The distal end 102*a* of the handle assembly 102 is coupled to the connecting fixture 106. The connecting fixture 106 is capable of being received in a receptacle (not shown) for a lighting appliance, such as a receptacle for bulbs, lamps and the like, thereby securing the apparatus 100 to the receptacle. Accordingly, the connecting fixture 106 may enable an electrical coupling between the apparatus 100 and the receptacle for the lighting appliance.

In an embodiment of the present invention, the connecting fixture 106 includes a screw base 106*a* having threads thereon, and a contact terminal 106*b* for enabling the electrical coupling between the apparatus 100 and the receptacle. The threads on the screw base 106*a* are received in complementary thread arrangement (not shown) configured within the receptacle, thereby enabling the connecting fixture 106 to be coupled to the receptacle. Upon securing the connecting fixture 106 in the receptacle, the contact terminal 106*b* electrically couples to a contact terminal (not shown) of the receptacle, thereby enabling the electrical connection between the connecting fixture 106 and the receptacle. The electrical connection between the connecting fixture 106 and the receptacle will be explained in detail in conjunction with FIG. 2. The connecting fixture 106 may be similar to conventional fixtures used as electrical terminations on standard bulbs or lamps and may be made from a conducting material, such as brass and the like. Moreover, the connecting fixture 106 may be coupled to the distal end 102*b* of the handle assembly 102 by any conventional method, such as, but not limited to, a thread coupling arrangement.

The proximal end 102*a* of the handle assembly 102 includes a neck portion 108 extending therefrom such that a longitudinal axis (not shown) of the neck portion 108 coincides with the longitudinal axis 'y' of the handle assembly 102. The neck portion 108 of the handle assembly 102 is adapted to pivotally secure the air circulation assembly 104 thereto by an attachment means 110 configured on the air circulation assembly 104. More specifically, the neck portion 108 of the handle assembly 102 and the attachment means 110 configure a joint, which enables an angular motion of the air circulation assembly 104 in all directions about the longitudinal axis 'y' of the handle portion 102. It will be evident to a person skilled in the art that the angular motion of the air circulation assembly 104 about the handle assembly 102 adjusts the direction of the air-flow generated from the air circulation assembly 104. The joint configured between the attachment means 110 and the neck portion 108 will be explained in detail in conjunction with FIGS. 2 and 3.

Further, the air circulation assembly 104 may include screen assemblies, for example, screen assemblies 112 and 114, secured to ends of the air circulation assembly 104. The screen assemblies 112 and 114 are adapted to restrict any access to at least one component disposed within the air circulation assembly 104, thereby preventing an accident or mishap. The screen assemblies 112 and 114 will be described in detail in conjunction with FIG. 2.

Additionally, the apparatus 100 may include a switch S1 configured on the air circulation assembly 104. The switch S1 is configured to control at least one operation of the air circulation assembly 104. For example, the switch S1 may be utilized for enabling or disabling the air circulation assembly 104 for generating the air flow. In one embodiment of the present invention, the switch S1 may be a conventional slide switch having a plurality of contact terminals for controlling the at least one operations of the air circulation assembly 104. However, it will be evident to a person skilled in the art that the present invention may utilize any other type of switch also that is adapted to control the at least one operation of the air circulation assembly 104.

Figure 2:
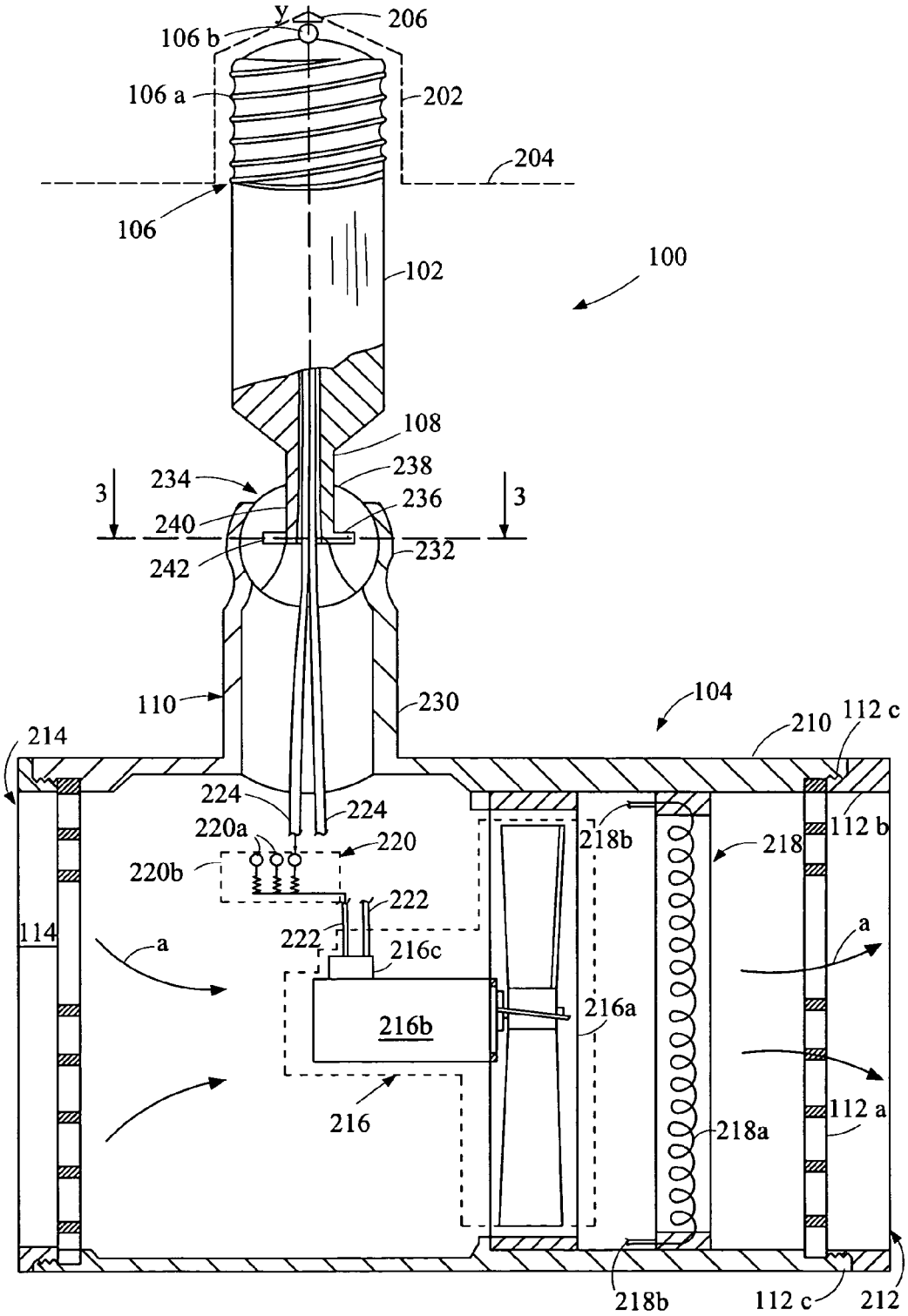
FIG. 2 illustrates a sectional view of the apparatus as shown in FIG. 1 cut along sectional line 2-2 in FIG. 1.
Figure 3:
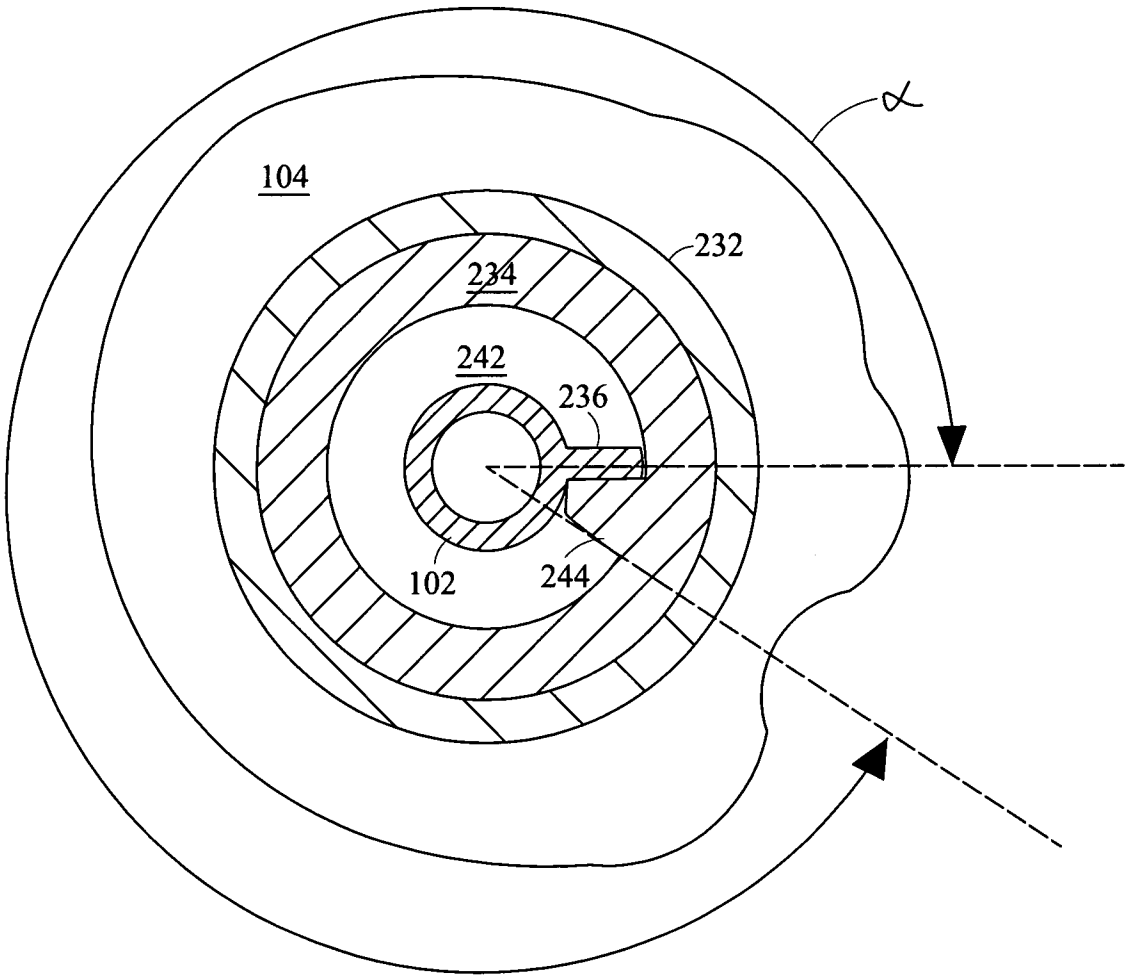
FIG. 3 illustrates a sectional view of the apparatus as shown in FIG. 2 cut along sectional line 3-3 in FIG. 2.

An internal configuration of the apparatus 100 may be explained in conjunction with FIGS. 2 and 3, where FIG. 2 illustrates a sectional view of the apparatus 100 cut along sectional line 2-2 in FIG. 1. Further, FIG. 3 illustrates a sectional view of the apparatus 100 cut along sectional line 3-3 in FIG. 2.

The apparatus 100 may be received in a receptacle 202 by means of the connecting fixture 106. It should be understood that the receptacle 202 is similar to a conventional receptacle for lighting appliances, provided in a wall or a ceiling, for example, a ceiling 204 of a room. Accordingly, the threads of the screw base 106*a* enable the connecting fixture 106 to be coupled to the complementary threads within the receptacle 202, thereby configuring an electrical connection between the contact terminal 106*b* of the apparatus 100 and a contact terminal 206 of the receptacle. The said electrical connection of the apparatus 100 with the contact terminal 206 enables the apparatus 100 to circulate air in the room.

Further, the air circulation assembly 104 of the apparatus 100 includes a hollow cylindrical housing 210, herein after referred to as the cylindrical housing 210, having a front end 212 and a rear end 214, a fan-motor assembly 216 for generating an air-flow, and a heating element 218 for heating the air-flow generated by the fan-motor assembly 216. The air circulation assembly 104 further includes a circuitry 220 for electrically coupling the fan-motor assembly 216 and the heating element 218 to the connecting fixture 106. In one embodiment of the present invention, the fan-motor assembly 216 and the heating element 218 are linearly aligned within the cylindrical housing 210. More specifically, the fan-motor assembly 216 is disposed proximal to the rear end 214 of the cylindrical housing 210 and the heating element 218 is disposed proximal to the front end 212 of the cylindrical housing 210.

The fan-motor assembly 216 includes a fan 216*a*, and a motor 216*b* operatively coupled to the fan 216*a*. The fan-motor assembly 216 further includes a plurality of contact terminals 216*c* for providing an electrical connection to the fan-motor assembly 216. During operation, the fan-motor assembly 216 is configured to pull air from the rear end 214 of the cylindrical housing 210 and force the pulled air towards the front end 212 of the cylindrical housing 210, thereby generating the air-flow. More specifically, FIG. 2 illustrates the air-flow with arrows 'a' passing over the heating element 218 while being forced towards the front end 212 of the cylindrical housing 210. In one embodiment of the present invention, the heating element 218 is operatively coupled to the fan-motor assembly 216 such that in the event that the fan-motor assembly 216 is inoperable, the heating element 218 will also be rendered inoperable.

The heating element 218 includes a resistive element 218*a* and at least two contact terminals 218*b* for providing electrical connection to the resistive element 218*a*. In operation, when electrical power is supplied to the heating element 218, the heating element 218 gets heated-up, thereby heating the air-flow 'a' passing over the heating element 218. The heating element 218 may include a conventional electrical heating element made from a metallic material of high resistance value. However, it will be obvious to a person skilled in the art that the present invention may utilize other conventionally available configurations of heating elements without departing from the scope thereof.

The electrical power may be supplied to the heating element 218 and the fan-motor assembly 216 by means of the circuitry 220. The circuitry 220 may include a plurality of contact terminals 220*a* (hereinafter referred to as contact terminals 220*a*) configured on a conducting board 220*b*. The conducting board 220*b* may include associated electrical connections and elements. It will be evident to a person skilled in the art that the present invention is not limited to the circuitry 220, but may include other possible variations of the circuitry 220. The contact terminals 220*a* are capable of receiving connecting wires, such as connecting wires 222, from the contact terminals 216*c* of the fan-motor assembly 216 and the contact terminals 218*b* of the heating element 218. Furthermore, the contact terminals 220*a* are adapted to receive connecting wires, such as connecting wires 224 for electrically coupling the circuitry 220 to the connecting fixture 106. More specifically, the connecting wires 224 provide an electrical connection between the circuitry 220 and the connecting fixture 106, thereby enabling the electrical coupling between the air circulation assembly 104 and the receptacle 202.

The air circulation assembly 104 further includes the switch S1 configured thereon for operating the apparatus 100, as shown and described in FIG. 1. More specifically, the switch S1 may be electrically coupled to the circuitry 220 for selectively controlling the operation of at least one of the fan-motor assembly 216 and the heating element 218. The switch S1 may be utilized to independently or collectively operate the at least one of the fan-motor assembly 216 and the heating element 218. More specifically, when it is desired to circulate hot or warm air in the room, each of the fan-motor assembly 216 and the heating element 218 may be operated. Accordingly, the switch S1 may be adjusted to select heating operation of the apparatus 100. Alternatively, when it is desired to recirculate the air in a poorly ventilated room, the switch S1 may be adjusted to operate only the fan-motor assembly 216. In one embodiment of the present invention, the switch S1 is configured to control speed of the fan-motor assembly 216. More specifically, the switch S1 may be operated to adjust a speed of the hot air being generated by the apparatus 100.

The air circulation assembly 104 may also include the screen assemblies 112 and 114 coupled to the front end 212 and the rear end 214, respectively, of the cylindrical housing 210 thereof. Each of the screens assemblies 112, and 114 include a screen member, and a rim member disposed about a periphery of the screen member. For example, the screen assembly 112 includes a screen member 112*a*, and a rim member 112*b*. The screen member 112*a* is adapted to restrict an access to the various components disposed within the air circulation assembly, such as the fan-motor assembly 216, the heating element 218 and the circuitry 220.

The rim member 112*b* may include threads 112*c* provided on a peripheral surface thereof. Furthermore, an inner peripheral surface of the front end 212 of the air circulation assembly 104 may be provided with complementary threads, adapted to receive the threads 112*c* of the rim member 112*b*. The screen assembly 114 may be configured similar to the screen assembly 112 for coupling at the rear end 214 of the cylindrical housing 210. It will be evident to a person skilled in the art that the rim member, for example, the rim member 112*b* of the screen assembly, for example, the screen assembly 112 may be coupled to the air circulation assembly 104 by means of any other conventional coupling mechanism.

As already mentioned, the air circulation assembly 104 further includes the attachment means 110 extending from the air circulation assembly 104. Preferably, the attachment means 110 and the air circulation assembly 104 may be configured as a single unit. Alternatively, the attachment means 110 and the air circulation assembly 104 may be manufactured separately, and assembled thereafter to form a single unit.

As used herein, the attachment means 110 includes a hollow tubular portion 230 extending from the air circulation assembly 104, and a hollow spherical portion 232 extending from an end portion of the hollow tubular portion 230. The hollow spherical portion 232 is adapted to configure a joint, more specifically, a ball and a socket joint, between the handle assembly 102 and the air circulation assembly 104. More specifically, the handle assembly 102 includes a sphere portion 234 coupled to an end of the neck portion 108 of the handle assembly 102, such that the sphere portion 234 functions as the ball of the ball and socket joint. The sphere portion 234 includes an outer surface 238, and a bore 240 configured longitudinally within the sphere portion 234. The sphere portion 234 is adapted to be at least partially enclosed by the hollow spherical portion 232 of the attachment means 110 to configure the ball and socket joint. More specifically, the hollow spherical portion 232 of the attachment means 110 partially encloses the outer surface 238 of the sphere portion 234 forming a frictional fit thereon, to configure the ball and socket joint between the air circulation assembly 104 and the handle assembly 102.

Further, as shown in FIG. 2, the bore 240 is configured within the sphere portion 234 such that it extends from the outer surface 238 to a central portion of the sphere portion 234. More specifically, a longitudinal axis (not shown) of the bore 240 coincides with the longitudinal axis 'y' of the handle assembly 102. Further, a horizontal slot 242 is configured within the sphere portion 234 at an end of the bore 240 and in a direction perpendicular to the longitudinal axis of the bore 240. The horizontal slot 242 is enabled to couple the sphere portion 234 to the end of the neck portion 108 of the handle assembly 102. The handle assembly 102 includes a horizontal projection 236 configured at the end of the neck portion 108 thereof. As shown in FIGS. 2 and 3, the horizontal projection 236 is aligned perpendicular to the longitudinal axis 'y' of the handle assembly 102. The horizontal projection 236 is configured to be received within the horizontal slot 242, thereby enabling the coupling between the neck portion 108 and the sphere portion 234.

With reference to FIGS. 2 and 3, the horizontal projection 236 of the handle assembly 102 is received within the horizontal slot 242 of the sphere portion 234. Further, the horizontal projection 236 is capable of a rotational motion in a horizontal plane within the horizontal slot 242. Consequently, the sphere portion 234 is adapted to be rotated in a horizontal plane about the longitudinal axis 'y' of the handle assembly 102. Accordingly, the ball and socket joint, configured between the attachment means 110 and the sphere portion 234, enables a pivotal movement of the air circulation assembly 104 in a vertical plane about the longitudinal axis 'y' of the handle assembly 102. The pivotal movement of the air circulation assembly 104 will be explained further in conjunction with FIG. 4.

Further, the ball and socket joint facilitates a rotational motion of the air circulation assembly 104 in a horizontal plane about the handle assembly 102 as a result of the rotational motion of the sphere 234 about the handle assembly 102. Accordingly, the ball and socket joint disclosed herein enables an angular motion of the air circulation assembly 104 in all directions about the handle assembly 102. The angular motion, as used herein, comprises a rotational motion in a horizontal plane and a pivotal motion in a vertical plane.

Further, as shown in FIG. 2, the bore 240 extending within the sphere portion 234 may be configured to allow passage of the connecting wires, such as the connecting wires 224, therethrough. As described earlier, the connecting wires 224 are adapted to electrically couple the fan-motor assembly 216 and the heating element 218 to the connecting fixture 106 of the apparatus 100. More specifically, the connecting wires 224 coupled at one end to the circuitry 220 extend through the hollow tubular portion 230 of the attachment means 110 and the bore 240 of the sphere portion 234. The connecting wires 224 further extend through the hollow portion of the handle assembly 102 to electrically couple to the connecting fixture 106.

Further, during the rotational motion of the air circulation assembly 104 about the handle assembly 102, the connecting wires 224 may twist around each other. More specifically, a repeated rotation of the air circulation assembly 104 in one particular direction may result in entangling of the connecting wires 224 with each other, thereby damaging the connecting wires 224. Accordingly, to prevent entangling of the connecting wires 224, the sphere portion 234 of the apparatus 100 includes a stopper means 244. The stopper means 244 may be configured within the horizontal slot 242 of the sphere 234 for restricting the rotation of the air circulation assembly 104 by a complete circle. As shown in FIG. 3, the stopper means 244 restricts the rotational movement of the horizontal projection 236 to an angle of rotation '$\alpha$'. The angle of rotation '$\alpha$' has a maximum value less than 360 degrees, thereby restricting rotation of the air circulation assembly 104 by a complete circle. Accordingly, the restriction of the angle of rotation prevents the connecting wires 224 from being entangled with each other.

Figure 4:
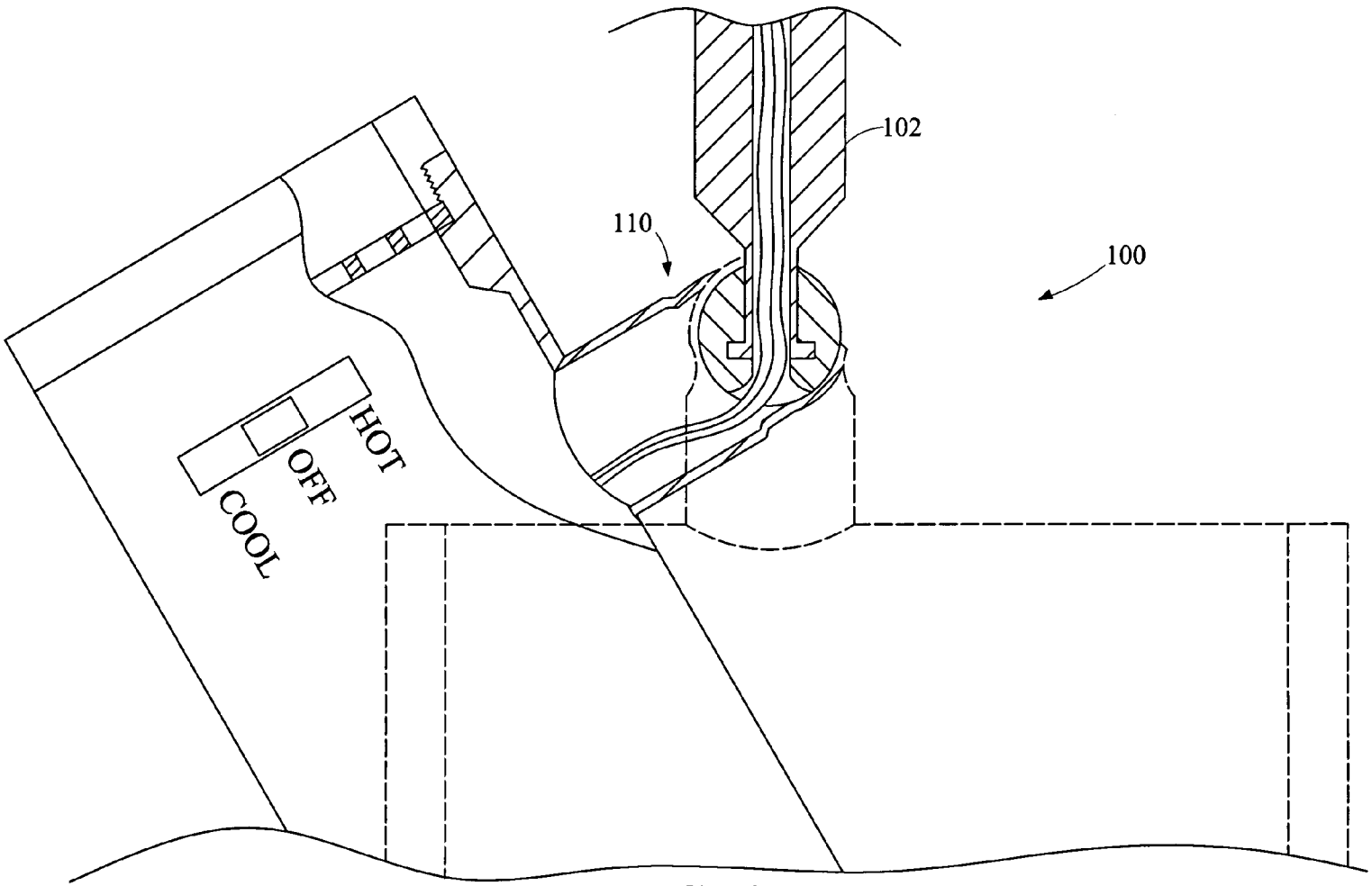
FIG. 4 illustrates a partial sectional view of an apparatus for circulating air illustrating a possible position of the apparatus during operation thereof, in accordance with an exemplary embodiment of the present invention.

FIG. 4 depicts a partial sectional view of the apparatus 100 in one of possible position of the apparatus 100 during operation thereof. More specifically, FIG. 4 illustrates the position of the air circulation assembly 104 during the pivotal motion thereof in a vertical plane (not shown) about the longitudinal axis 'y' of the handle assembly 102.

The apparatus for circulating air, as disclosed herein, envisages following advantages. The apparatus evenly circulates air inside a work area, for example, a room, by adjusting a direction of air-flow generated by the apparatus. More specifically, the direction of the air-flow generated from the apparatus may be adjusted in a desired direction by a pivotal, rotational or a combination of pivotal and rotational motion of the apparatus. Further, the apparatus may be easily installed in the work area without requiring an extensive ductwork to be carried out. Accordingly, the apparatus, as disclosed by the present invention, is simple, easy to use and cost-effective.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is understood that various omissions and substitutions of equivalents are contemplated as circumstances may suggest or render expedient, but these are intended to cover the application or implementation without departing from the spirit or scope of the claims of the present invention.

What is claimed is:

1. An apparatus for circulating air, comprising: a hollow handle assembly having a proximal end and a distal end; an air circulation assembly pivotally secured to the proximal end of the hollow handle assembly, the air circulation assembly capable of generating an air-flow; a connecting fixture capable of being received in a receptacle for a light appliance, and configured to provide an electrical connection to the apparatus for circulating air; the air circulation assembly further comprises an attachment means for enabling an angular motion of the air circulation assembly about a longitudinal axis of the hollow handle assembly for adjusting a direction of the air-flow generated from the air circulation assembly, the proximal end of the hollow handle assembly comprises a neck portion comprising a horizontal projection extending from an end thereof, wherein the horizontal projection is perpendicular to the longitudinal axis of the hollow handle assembly, and wherein the horizontal projection enables a rotational movement of the air circulation assembly about the longitudinal axis of the hollow handle assembly, the proximal end of the hollow handle assembly further comprises a sphere portion rotatably secured to the neck portion, the sphere portion comprises an outer surface capable of receiving the attachment means of the air circulation assembly thereon for pivotally securing the air circulation assembly to the hollow handle assembly, a bore configured within the sphere portion, the bore extending along the longitudinal axis of the hollow handle assembly from the outer surface of the sphere portion towards a central portion of the sphere portion; a horizontal slot configured at an end of the bore within the sphere portion, and adapted to receive the horizontal projection of the neck portion of the hollow handle assembly for allowing the rotational movement of the air circulation assembly about the longitudinal axis of the hollow handle assembly; and the attachment means comprises a hollow tubular portion extending from the air circulation assembly, and a hollow spherical portion configured on an end portion of the hollow tubular portion and configured to at least partially enclose the outer surface of the sphere portion and forming a frictional fit thereon.

2. The apparatus of claim 1, wherein the air circulation assembly, comprises;

a hollow cylindrical housing having a front end and a rear end;

a fan-motor assembly disposed within the hollow cylindrical housing, and capable of pulling air from the rear end of the hollow cylindrical housing and forcing air towards the front end of the hollow cylindrical housing to generate the air-flow;

a heating element disposed near the front end of the hollow cylindrical housing, and capable of heating the air forced towards the front end of the hollow cylindrical housing by the fan-motor assembly; and a circuitry for electrically coupling at least one of the fan-motor assembly and the heating element to the connecting fixture of the apparatus.

3. The apparatus of claim 2, wherein the air circulation assembly further comprises a switch configured on the hollow cylindrical housing, the switch capable of allowing a user to selectively control at least one operation of at least one of the fan motor assembly and the heating element.

4. The apparatus of claim 3, wherein the air circulation assembly further comprises a screen assembly secured to at least one of the front end and the rear end of the hollow cylindrical housing for restricting an access to at least one component within the air circulation assembly.

5. The apparatus of claim 4, wherein the screen assembly comprises a rim member adapted to secure the screen assembly to at least one of the rear end and the front end of the hollow cylindrical housing.

6. The apparatus of claim 1, wherein the connecting fixture comprises a screw base having threads thereon, and adapted to be received in the receptacle for the lighting appliance, and a contact terminal disposed on an end of the connecting fixture, and adapted to electrically couple the apparatus to the receptacle for the lighting appliance.

* * * * *